US008711088B2

(12) United States Patent
Miyasaka et al.

(10) Patent No.: US 8,711,088 B2
(45) Date of Patent: Apr. 29, 2014

(54) METHOD FOR DRIVING ELECTROPHORETIC DISPLAY DEVICE, ELECTROPHORETIC DISPLAY DEVICE, AND ELECTRONIC DEVICE

(75) Inventors: Eiji Miyasaka, Suwa (JP); Hidetoshi Saito, Suwa (JP); Kazuki Imai, Okaya (JP)

(73) Assignee: Seiko Epson Corporation (JP)

( * ) Notice: Subject to any disclaimer, the term of this patent is extended or adjusted under 35 U.S.C. 154(b) by 325 days.

(21) Appl. No.: 12/963,961

(22) Filed: Dec. 9, 2010

(65) Prior Publication Data

US 2011/0141156 A1 Jun. 16, 2011

(30) Foreign Application Priority Data

Dec. 10, 2009 (JP) ..... 2009-280633

(51) Int. Cl.
*G09G 3/34* (2006.01)

(52) U.S. Cl.
USPC ..... 345/107

(58) Field of Classification Search
USPC ..... 345/204, 690–693, 84–111
See application file for complete search history.

(56) References Cited

U.S. PATENT DOCUMENTS

| | | | | |
|---|---|---|---|---|
| 2002/0021483 | A1* | 2/2002 | Katase | 359/267 |
| 2008/0136773 | A1* | 6/2008 | Kim et al. | 345/107 |
| 2008/0211833 | A1 | 9/2008 | Inoue | |

FOREIGN PATENT DOCUMENTS

| | | | |
|---|---|---|---|
| JP | 2008-209893 | | 9/2008 |
| JP | 2009-204812 | A | 9/2009 |
| WO | WO-2008-153212 | A1 | 12/2008 |

* cited by examiner

*Primary Examiner* — Liliana Cerullo
(74) *Attorney, Agent, or Firm* — Harness, Dickey & Pierce, P.L.C.

(57) ABSTRACT

A method for driving an electrophoretic display device that includes a display unit having a plurality of pixels and an electrophoretic element provided between a pair of substrates is provided. The method includes displaying on the display unit a third image that includes an image component of a first image and an image component of a second image before changing the first image displayed on the display unit to the second image.

16 Claims, 11 Drawing Sheets

METHOD FOR DRIVING ELECTROPHORETIC DISPLAY DEVICE, ELECTROPHORETIC DISPLAY DEVICE, AND ELECTRONIC DEVICE

BACKGROUND

1. Technical Field

The present invention relates to a method for driving an electrophoretic display device, an electrophoretic display device, and an electronic device.

2. Related Art

A method for driving an electrophoretic display device has been proposed, in which when it is necessary to switch between images at a high speed in order to display a clock time or the like, pixels are driven so that the particles do not reach a saturated position, whereby the images are displayed in an intermediate color (refer to, for example, JP-A-2008-209893).

In the driving method described in JP-A-2008-209893, it is possible to switch between images at a high speed and reduce power consumption by reducing the time for driving the pixels. However, in an electrophoretic display device that has a memory property, it is necessary that after an originally displayed image is deleted, another image be displayed. Thus, in the driving method described in JP-A-2008-209893, it is necessary that after an originally displayed image is deleted, another image be displayed. Although the operation for displaying images in the intermediate color can be performed at a high speed, a blank image may be displayed between the images, or the images may be displayed after a certain waiting period. Therefore, the display quality may be insufficient in the driving method described in JP-A-2008-209893.

SUMMARY

An advantage of some aspects of the invention is to provide a method for driving an electrophoretic display device and an electrophoretic display device, which suppress the display of a blank image and the display of an image after a waiting period and provide an improved display quality.

According to a first aspect of the invention, a method for driving an electrophoretic display device that includes a display unit having a plurality of pixels and an electrophoretic element provided between a pair of substrates is provided. The method includes displaying on the display unit a third image that includes an image component of a first image and an image component of a second image before changing the first image displayed on the display unit to the second image.

In the method according to the first aspect of the invention, the first image is updated to the second image after the third image that includes the image component of the first image and the image component of the second image is displayed. The third image can be displayed by writing the second image over the first image without deleting the first image. Thus, it is possible to prevent a blank image from being displayed on the display unit during rewriting of the image and prevent a waiting period during rewriting of the image. It is, therefore, possible to provide an improved display quality.

In the method, it is preferable that at least a part of the third image be displayed in an intermediate gradation during the displaying the third image.

In the method, since the part of the third image is displayed in the intermediate gradation, the first image can be changed to the second image by driving pixels for a short time. When the gradation value (density) of the first image is different from the gradation value (density) of the second image, a user can identify the first image and the second image during the displaying the third image.

In the method, it is preferable that the third image include at least either a part of an image formed by reversing the first image by changing the gradation of the first image or a part of an image formed by reversing the second image by changing the gradation of the second image.

In the method, a cursor-like rectangular region can be displayed in a region in which the image is rewritten. Thus, a user can identify the fact that the image is being written. It is, therefore, possible to reduce stress of the user.

In the method, it is preferable that subtracted image data be used during the displaying the third image, the subtracted image data being obtained by arithmetic processing performed using image data corresponding to the second image or image data corresponding to an image formed by reversing the second image by changing the gradation of the second image and image data corresponding to the first image or image data corresponding to an image formed by reversing the first image by changing the gradation of the first image.

In the method, the displayed image can be updated while pixels that correspond to a common portion of the first and second images are not driven. Thus, it is possible to reduce loads that are applied to the electrophoretic element and semiconductor elements that drive the pixels.

It is preferable that the method include deleting the first image immediately before or after the displaying the third image. In the driving method, the first image is gradually changed to the second image.

In the method, it is preferable that subtracted image data be used during the deleting the first image, the subtracted image data being obtained by arithmetic processing performed using image data corresponding to the second image or image data corresponding to an image formed by reversing the second image by changing the gradation of the second image and image data corresponding to the first image or image data corresponding to an image formed by reversing the first image by changing the gradation of the first image.

In the method, the image can be deleted while pixels that correspond to a common portion of the first and second images are not driven. Thus, it is possible to reduce loads that are applied to the electrophoretic element and semiconductor elements that drive the pixels.

It is preferable that the method include deleting at least a part of an outline of the first image after the deleting the first image. In the method, an artifact of the outline of the first image can be deleted and it is possible to provide an improved display quality.

It is preferable that image data that is obtained by subtracting image data on the outline of the first image from image data on the second image is used during the deleting at least the part of the outline of the first image.

In the method, the artifact of the outline of the first image can be deleted while pixels that correspond to a common portion of the first and second images are not driven. Thus, it is possible to reduce loads that are applied to the electrophoretic element and semiconductor elements that drive the pixels. In addition, it is possible to suppress deterioration (due to an operation of deleting the outline) of the balance of a current in the electrophoretic element.

According to a second aspect of the invention, an electrophoretic display device includes: a display unit that includes a plurality of pixels and an electrophoretic element provided between a pair of substrates; and a control section that controls the pixels, wherein the control section performs a combined image display operation to cause the display unit to display a third image that includes an image component of a first image and an image component of a second image before the first image that is displayed on the display unit is changed to the second image.

In the electrophoretic display device, the first image is updated to the second image after the third image that includes the image component of the first image and the image component of the second image is displayed. The third image can be displayed by writing the second image over the first image without deleting the first image. Thus, it is possible to prevent a blank image from being displayed on the display unit during rewriting of the image and prevent a waiting period during rewriting of the image. It is, therefore, possible to provide an improved display quality.

In the electrophoretic display device, it is preferable that the control section cause the display unit to display at least a part of the third image in an intermediate gradation during the combined image display operation.

In the electrophoretic display device, since the part of the third image is displayed in the intermediate gradation, the first image can be changed to the second image for a short time for which pixels are driven. When the gradation value (density) of the first image is different from the gradation value (density) of the second image, a user can identify the first image and the second image during displaying of the third image.

It is preferable that the third image include at least either a part of an image formed by reversing the first image by changing the gradation of the first image or a part of an image formed by reversing the second image by changing the gradation of the second image.

In the electrophoretic display device, a cursor-like rectangular region can be displayed in a region in which the image is rewritten. Thus, a user can identify the fact that the image is being written. In addition, it is possible to reduce stress of the user.

It is preferable that image data used in the combined image display operation is subtracted image data obtained by arithmetic processing performed using image data corresponding to the second image or image data corresponding to an image formed by reversing the second image by changing the gradation of the second image and image data corresponding to the first image or image data corresponding to an image formed by reversing the first image by changing the gradation of the first image.

In the electrophoretic display device, the displayed image can be updated while pixels that correspond to a common portion of the first and second images are not driven. Thus, it is possible to reduce loads that are applied to the electrophoretic element and semiconductor elements that drive the pixels.

It is preferable that the control section perform an image deleting operation to delete the first image immediately before or after the combined image display operation. In the electrophoretic display device, the first image can be gradually changed to the second image.

It is preferable that image data used in the image deleting operation be subtracted image data obtained by arithmetic processing performed using image data corresponding to the second image or image data corresponding to an image formed by reversing the second image by changing the gradation of the second image and image data corresponding to the first image or image data corresponding to an image formed by reversing the first image by changing the gradation of the first image.

In the electrophoretic display device, the image can be deleted while pixels that correspond to a common portion of the first and second images are not driven. Thus, it is possible to reduce loads that are applied to the electrophoretic element and semiconductor elements that drive the pixels.

It is preferable that the control section perform an outline deleting operation to delete at least a part of an outline of the first image after the image deleting operation. In the electrophoretic display device, an artifact of the outline of the first image can be deleted, and it is possible to provide an improved display quality.

It is preferable that image data used in the outline deleting operation be image data obtained by subtracting image data on the outline of the first image from image data on the second image.

In the electrophoretic display device, the artifact of the outline of the first image can be deleted while pixels that correspond to a common portion of the first and second images are not driven. Thus, it is possible to reduce loads that are applied to the electrophoretic element and semiconductor elements that drive the pixels. In addition, it is possible to suppress deterioration (due to an operation of deleting the outline) of the balance of a current in the electrophoretic element.

According to a third aspect of the invention, an electronic device includes the electrophoretic display device according the above described aspect of the invention.

The electronic device includes the electrophoretic display device that provides an excellent display quality.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention are described with reference to the accompanying drawings.

The scope of the invention is not limited to the embodiments described below, and the invention may be modified without departing from the technical spirit and scope of the invention. In addition, in the accompanying drawings, the scale sizes of structures and the numbers of elements are different from the actual scale sizes and the actual numbers in some cases in order to clarify each of configurations.

Figure 1:
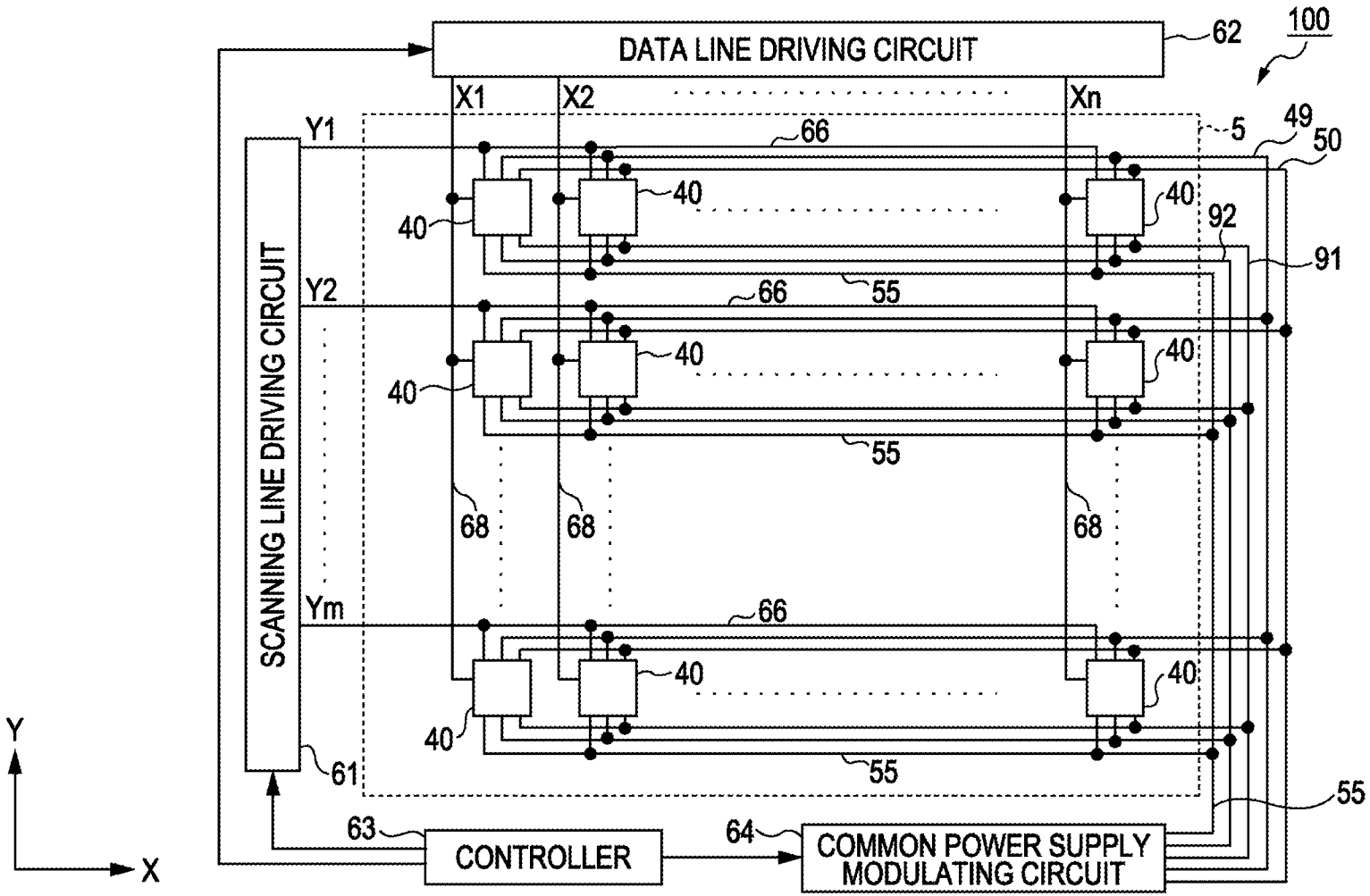
FIG. 1 is an outline diagram illustrating the configuration of an electrophoretic display device according to an embodiment of the invention.

FIG. 1 is an outline diagram illustrating the configuration of an electrophoretic display device 100 according to an embodiment of the invention. The electrophoretic display device 100 includes a display unit 5 that has a plurality of pixels 40 arranged in a matrix form. A scanning line driving circuit 61, a data line driving circuit 62, a controller (control section) 63, and a common power supply modulating circuit 64 are arranged around the display unit 5. The scanning line driving circuit 61, the data line driving circuit 62 and the common power supply modulating circuit 64 are connected to the controller 63. The controller 63 controls the scanning line driving circuit 61, the data line driving circuit 62 and the common power supply modulating circuit 64 on the basis of image data and a synchronization signal that have been supplied from a higher-level device.

A plurality of scanning lines 66 and a plurality of data lines 68 are arranged in the display unit 5. The scanning lines 66 extend from the scanning line driving circuit 61, while the data lines 68 extend from the data line driving circuit 62. Pixels 40 are arranged at locations corresponding to intersections of the scanning lines 66 and the data lines 68 in the display unit 5.

The scanning line driving circuit 61 is connected to the pixels 40 through m scanning lines 66 (Y1, Y2, . . . , Ym). The scanning line driving circuit 61 sequentially selects the scanning lines 66 arranged in the first to m-th rows and supplies selection signals through the selected scanning lines 66 to the pixels 40 under control of the controller 63. The selection signals each specify the time at which the selecting transistor 41 (refer to FIG. 2) arranged in the pixel 40 that receives the selection signal is turned on.

The data line driving circuit 62 is connected to the pixels 40 through n data lines 68 (X1, X2, . . . , Xn). The data line driving circuit 62 supplies image signals to the pixels 40 under control of the controller 63. The image signals each specify image data of one bit that corresponds to the pixel 40 that receives the image signal.

In the present embodiment, when the image data specifies "0", an image signal of a low (L) level is supplied to the pixel 40, and when the image data specifies "1", an image signal of a high (H) level is supplied to the pixel 40.

A low-potential power supply line 49, a high-potential power supply line 50 and a common electrode line 55 are arranged in the display unit 5 and extend from the common power supply modulating circuit 64. The low-potential power supply line 49, the high-potential power supply line 50 and the common electrode line 55 are connected to the pixels 40. The common power supply modulating circuit 64 generates various signals under control of the controller 63, and supplies the generated signals to the low-potential power supply line 49, the high-potential power supply line 50 and the common electrode line 55. In addition, the common power supply modulating circuit 64 performs electrical connections and disconnections (causing high impedance (Hi-Z)) of the lines 49, 50 and 55 under control of the controller 63.

Figure 2:
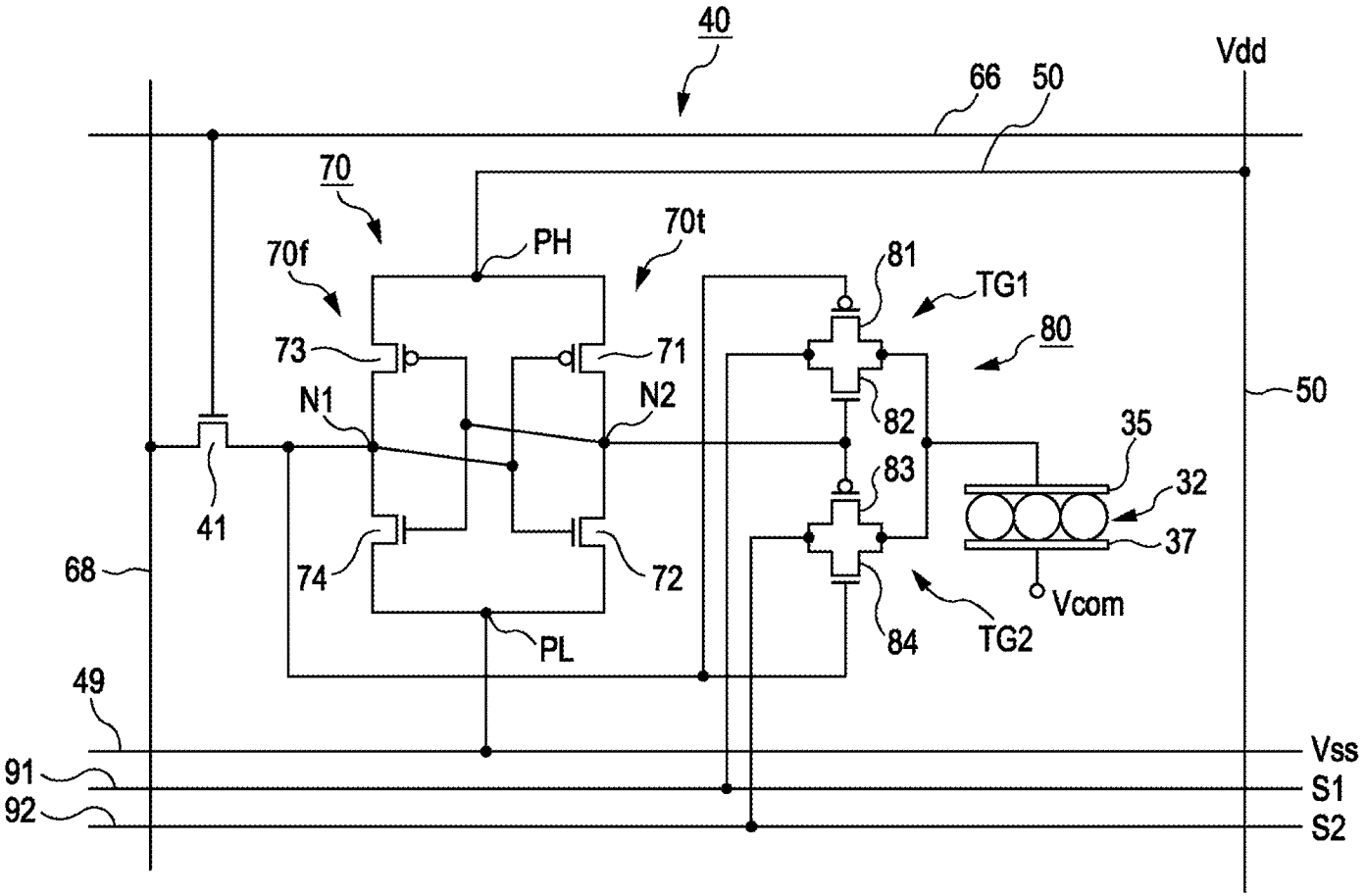
FIG. 2 is a diagram illustrating a pixel circuit.

FIG. 2 is a diagram illustrating a circuit configuration of the pixel 40.

The pixel 40 includes the selecting transistor 41 (pixel switching element), a latch circuit (memory circuit) 70, a switching circuit 80, an electrophoretic element 32, a pixel electrode 35 and a common electrode 37. The pixel 40 is connected to the scanning line 66, the data line 68, the low-potential power supply line 49, the high-potential power supply line 50, a first control line 91 and a second control line 92. The pixel 40 has a static random access memory (SRAM) structure in which an image signal is maintained as a potential by the latch circuit 70.

The selecting transistor 41 is a pixel switching element constituted by a negative metal oxide semiconductor (N-MOS) transistor. A gate terminal of the selecting transistor 41 is connected to the scanning line 66. A source terminal of the selecting transistor 41 is connected to the data line 68. A drain terminal of the selecting transistor 41 is connected to a data input terminal N1 of the latch circuit 70.

The latch circuit 70 includes a transfer inverter 70*t* and a feedback inverter 70*f*, which are C-MOS inverters. The transfer inverter 70*t* and the feedback inverter 70*f* form a loop structure. Specifically, an input terminal of the transfer inverter 70*t* is connected to an output terminal of the feedback inverter 70*f*, while an output terminal of the transfer inverter 70*t* is connected to an input terminal of the feedback inverter 70*f*. A power supply voltage is supplied to the inverters 70*t* and 70*f* from the high-potential power supply line 50 connected to the inverters 70*t* and 70*f* through a high-potential power supply terminal PH and from the low-potential power supply line 49 connected to the inverters 70*t* and 70*f* through a low-potential power supply terminal PL.

The transfer inverter 70*t* has a positive metal oxide semiconductor (P-MOS) transistor 71 and a negative metal oxide semiconductor (N-MOS) transistor 72. A drain terminal of the P-MOS transistor 71 and a drain terminal of the N-MOS transistor 72 are connected to a data output terminal N2. A source terminal of the P-MOS transistor 71 is connected to the high-potential power supply terminal PH, while a source terminal of the N-MOS transistor 72 is connected to the low-potential power supply terminal PL. A gate terminal of the P-MOS transistor 71 and a gate terminal of the N-MOS transistor 72, which serve as an input terminal of the transistor inverter 70*t*, are connected to a data input terminal N1 (serving as an output terminal of the feedback inverter 70*f*).

The feedback inverter 70*f* has a P-MOS transistor 73 and an N-MOS transistor 74. A drain terminal of the P-MOS transistor 73 and a drain terminal of the N-MOS transistor 74 are connected to the data input terminal N1. A gate terminal of the P-MOS transistor 73 and a gate terminal of the N-MOS transistor 74, which serve as an input terminal of the feedback inverter 70*f*, are connected to the data output terminal N2 (serving as an output terminal of the transfer inverter 70*t*).

The switching circuit 80 includes a first transmission gate TG1 and a second transmission gate TG2.

The first transmission gate TG1 is constituted by a P-MOS transistor 81 and an N-MOS transistor 82. A source terminal of the P-MOS transistor 81 and a source terminal of the N-MOS transistor 82 are connected to the first control line 91. A drain terminal of the P-MOS transistor 81 and a drain terminal of the N-MOS transistor 82 are connected to the pixel electrode 35. A gate terminal of the P-MOS transistor 81 is connected to the data input terminal N1 of the latch circuit 70, while a gate terminal of the N-MOS transistor 82 is connected to the data output terminal N2 of the latch circuit 70.

The second transmission gate TG2 is constituted by a P-MOS transistor 83 and an N-MOS transistor 84. A source terminal of the P-MOS transistor 83 and a source terminal of the N-MOS transistor 84 are connected to the second control line 92. A drain terminal of the P-MOS transistor 83 and a drain terminal of the N-MOS transistor 84 are connected to the pixel electrode 35. A gate terminal of the P-MOS transistor 83 is connected to the data output terminal N2 of the latch circuit 70. A gate terminal of the N-MOS transistor 84 is connected to the data input terminal N1 of the latch circuit 70. The electrophoretic element 32 is held between the pixel electrode 35 and the common electrode 37.

In the pixel that has the aforementioned configuration, when the image signal (image data specifying "0") of the low (L) level is stored in the latch circuit 70 and the image signal of the high (H) level is output from the data output terminal N2, the first transmission gate TG1 is turned on so that a potential S1 is applied to the pixel electrode 35 through the first control line 91.

On the other hand, when the image signal (image data specifying "1") of the high (H) level is stored in the latch circuit 70 and the image signal of the low (L) level is output from the data output terminal N2, the second transmission gate TG2 is turned on so that a potential S2 is applied to the pixel electrode 35 through the second control line 92.

The electrophoretic element 32 is driven on the basis of the difference between a potential Vcom applied to the common electrode 37 through the common electrode line 55 (refer to FIG. 1) and the potential S1 or S2 applied to the pixel electrode 35 so that an image is displayed in a gradation that corresponds to the image signal input to the pixel 40.

Figure 3A:
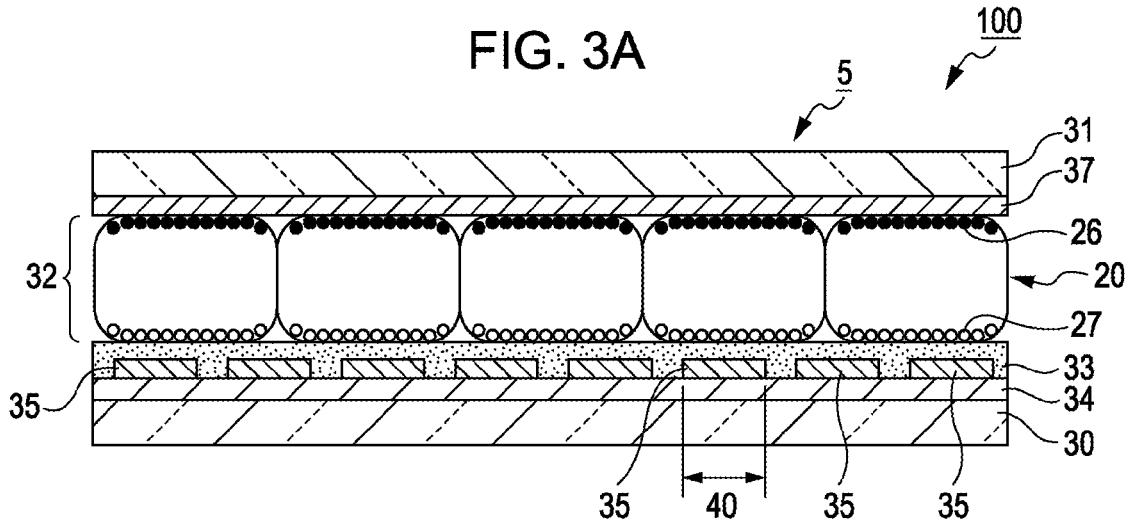
FIGS. 3A and 3B are a partial cross-sectional view of the electrophoretic display device and a cross-sectional view of a microcapsule, respectively.

FIG. 3A is a partial cross-sectional view of the electrophoretic display device 100 and illustrates the display unit 5 included in the electrophoretic display device 100. The electrophoretic display device 100 includes an element substrate (first substrate) 30, a facing substrate (second substrate) 31 and the electrophoretic element 32. The electrophoretic element 32 is held between the element substrate 30 and the facing substrate 31 and has a plurality of microcapsules 20 arrayed in the electrophoretic element 32.

A circuit layer 34 is arranged on the element substrate 30 on the side of the electrophoretic element 32. In the circuit layer 34, the scanning lines 66, the data lines 68, the selecting transistors 41, the latch circuits 70 and the like, which are illustrated in FIGS. 1 and 2, are arranged. A plurality of the pixel electrodes 35 are arranged on the circuit layer 34.

The element substrate 30 is made of glass, plastic or the like. The element substrate 30 may not be transparent since the element substrate 30 is located on the opposite side of an image display surface. The pixel electrodes 35 are layers formed by stacking plated nickel and plated gold on copper foil in this order or are made of aluminum, indium tin oxide (ITO) or the like. The pixel electrodes 35 apply voltages to the electrophoretic element 32.

The planar common electrode 37 is arranged on the facing substrate 31 on the side of the electrophoretic element 32 and faces the plurality of pixel electrodes 35. The electrophoretic element 32 is arranged on the common electrode 37.

The facing substrate 31 is made of glass, plastic or the like. The facing substrate 31 is transparent since the facing substrate 31 is located on the side of the image display surface. The common electrode 37 and the pixel electrodes 35 apply the voltages to the electrophoretic element 32. The common electrode 37 is a transparent electrode made of a magnesium-silver alloy (MgAg), indium tin oxide (ITO), indium zinc oxide (IZO) or the like.

The electrophoretic element 32 is bonded to the pixel electrodes 35 through an adhesive layer 33 so that the element substrate 30 joins the facing substrate 31.

In general, the electrophoretic element 32 is formed on the side of the facing substrate 31 in advance, and a sheet that includes the facing substrate 31, the electrophoretic element 32 and the adhesive layer 33 is treated as an electrophoretic sheet. In a manufacturing process, the electrophoretic sheet is treated while having a protective release sheet attached to the surface of the adhesive layer 33. The element substrate 30 (provided with the pixel electrodes 35, the circuits and the like) is formed separately from the electrophoretic sheet. Then, the release sheet is removed from the electrophoretic sheet, and the electrophoretic sheet is attached to the element substrate 30. In this manner, the display unit 5 is formed. Thus, the adhesive layer 33 is provided only on the side of the pixel electrodes 35.

Figure 3B:
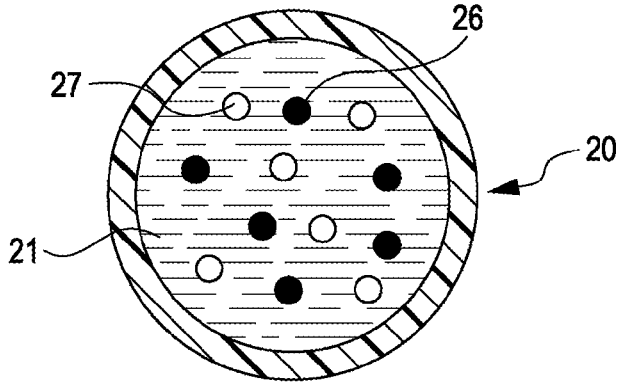

FIG. 3B is a schematic cross-sectional view of the microcapsule 20. The microcapsules 20 each have a diameter of approximately 50 μm, for example. The microcapsules 20 each have, encapsulated therein, a dispersion medium 21, a plurality of white particles (electrophoretic particles) 27, and a plurality of black particles (electrophoretic particles) 26. The microcapsules 20 are each formed in a spherical shape. As illustrated in FIG. 3A, the microcapsules 20 are held between the common electrode 37 and the pixel electrodes 35. At least one of the microcapsules 20 is included in each of the pixels 40.

Outer shell portions (wall film) of the microcapsules 20 include acrylic resin (such as polymethylmethacrylate or polyethylmethacrylate), urea resin, polymer resin such as gum arabic that has a light transmissive property, or the like.

The dispersion medium 21 is a liquid that causes the white particles 27 and the black particles 26 to disperse in the microcapsule 20. The dispersion medium 21 may be any of the following: water, an alcohol solvent (such as methanol, ethanol, isopropanol, butanol, octanol, or methyl cellosolve), an ester (such as ethyl acetate or butyl acetate), a ketone (such as acetone, methyl ethyl ketone, or methyl isobutyl ketone), aliphatic hydrocarbon (such as pentane, hexane, or octane), alicyclic hydrocarbon (such as cyclohexane or methylcyclohexane), aromatic hydrocarbon (such as benzene, toluene, or benzene (xylene, hexylbenzene, hebutylbenzene, octylbenzene, nonylbenzene, decylbenzene, undecylbenzene, dodecylbenzene, tridecylbenzene, or tetradecylbenzene) that has a long-chain alkyl group), halogenated hydrocarbon (such as methylene chloride, chloroform, carbon tetrachloride, or 1,2-dichloroethane), carboxylate, and other oil. A mixture of at least two of the aforementioned materials may be used as the dispersion medium 21. In addition, a surfactant or the like may be added to the dispersion medium 21.

The white particles 27 are particles (macromolecules or colloids) made of a white pigment such as titanium dioxide, zinc oxide, or antimony trioxide. The white particles 27 are negatively charged and used, for example. The black particles 26 are particles (macromolecules or colloids) made of a black pigment such as aniline black or carbon black. The black particles 26 are positively charged and used, for example.

An electrolyte, a surfactant, a metal soap, resin, rubber, oil, varnish, a charge controller including compound particles, a dispersant (such as a titanium coupling agent, an aluminum coupling agent or a silane coupling agent), a lubricant, a stabilizer or the like may be added to the pigments if necessary.

Instead of the black particles 26 and the white particles 27, red, green and blue pigments and the like may be used. In this configuration, red, green, blue images and the like can be displayed on the display unit 5.

Figure 4A:
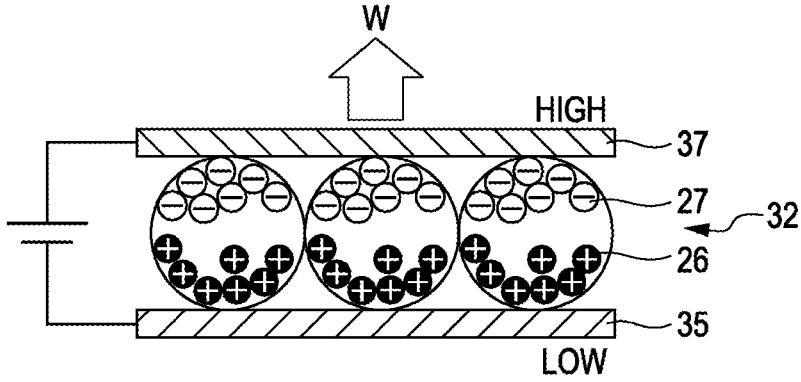
FIGS. 4A and 4B are diagrams illustrating an operation of the electrophoretic display device.
Figure 4B:
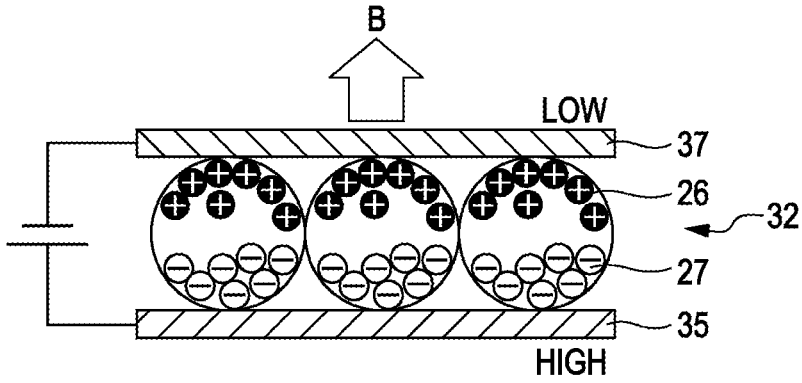

FIGS. 4A and 4B are diagrams illustrating an operation of the electrophoretic element. FIG. 4A illustrates the case in which the pixel 40 displays a white image, while FIG. 4B illustrates the case in which the pixel 40 displays a black image.

In the case illustrated in FIG. 4A, the potential of the common electrode 37 is maintained at a relatively high level, while the potential of the pixel electrode 35 is maintained at a relatively low level. Thus, the white particles 27 that are negatively charged are attracted to the common electrode 37, while the black particles 26 that are positively charged are attracted to the pixel electrode 35. As a result, a white (W) image is noticeable when the pixel 40 is viewed from the side of the display surface or from the side of the common electrode 37.

In the case illustrated in FIG. 4B, the potential of the common electrode 37 is maintained at a relatively low level, while the potential of the pixel electrode 35 is maintained at a relatively high level. Thus, the black particles 26 that are positively charged are attracted to the common electrode 37, while the white particles 27 that are negatively charged are attracted to the pixel electrode 35. As a result, a black (B) image is noticeable when the pixel 40 is viewed from the side of the common electrode 37.

Driving Method

Next, a method for driving the electrophoretic display device according to the present embodiment is described with reference to FIGS. 5 to 8.

Figure 5:
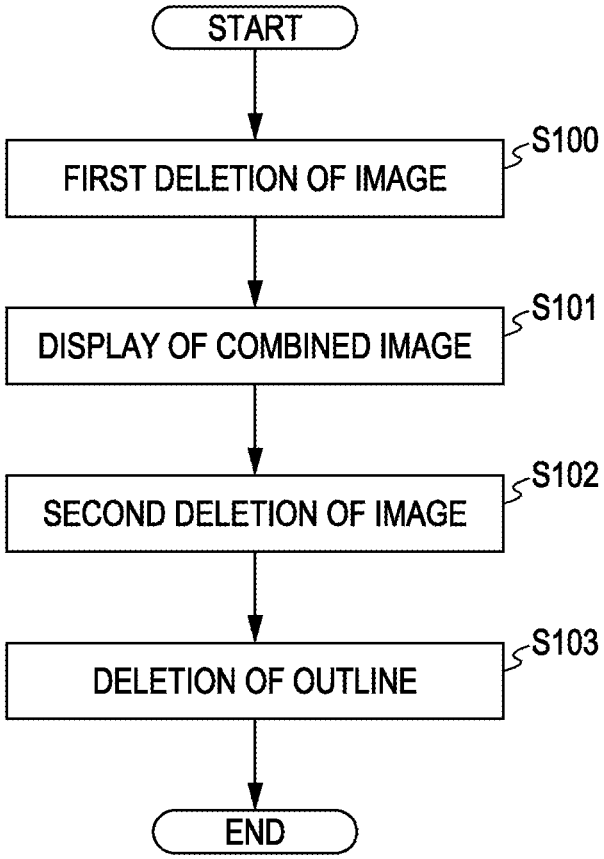
FIG. 5 is a flowchart of a driving method according to the embodiment.

FIG. 5 is a flowchart of the method for driving the electrophoretic display device 100.

Figure 6A:
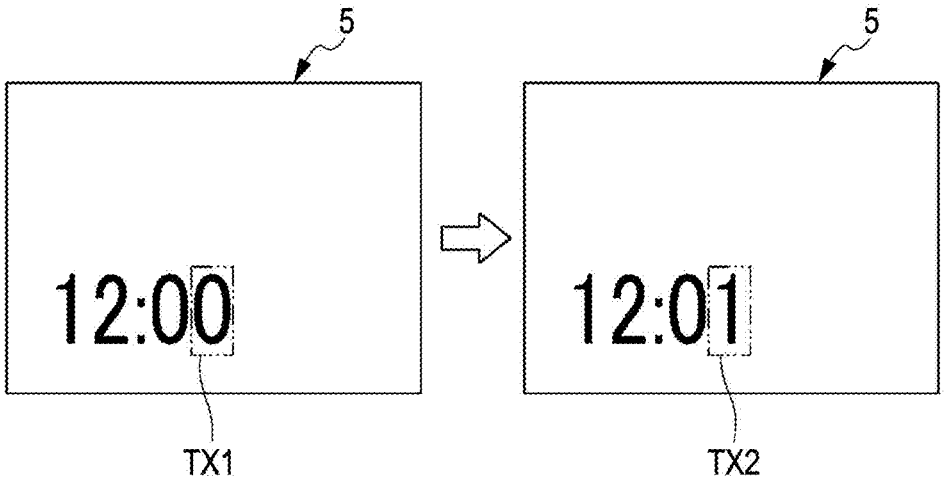
FIGS. 6A and 6B are diagrams illustrating a transition of a display state in the driving method according to the embodiment.
Figure 6B:
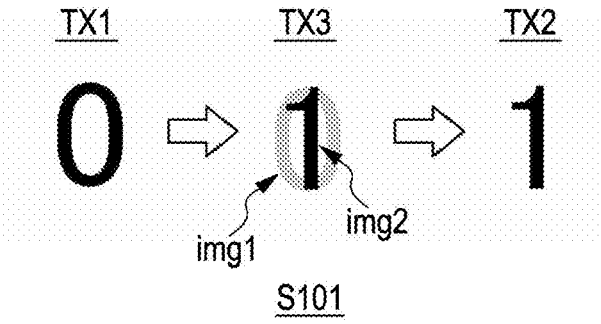

FIGS. 6A and 6B are diagrams illustrating a transition of a display state of the display unit 5 in the driving method according to the embodiment.

Figure 7A:
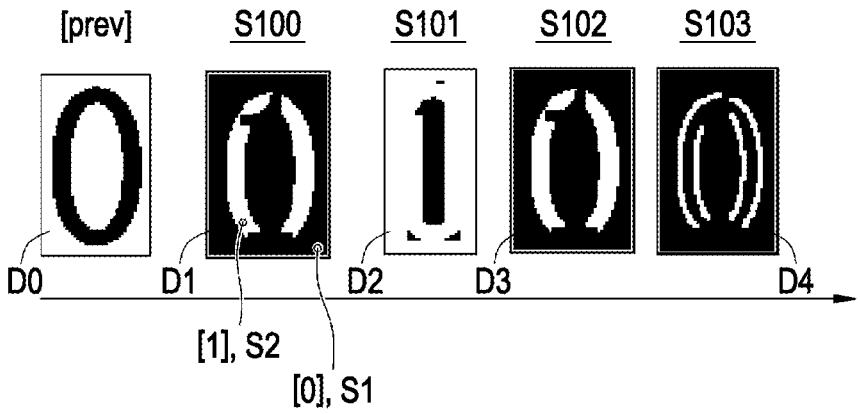
FIG. 7A is a diagram illustrating image data that is used in the driving method according to the embodiment.
Figure 7B:
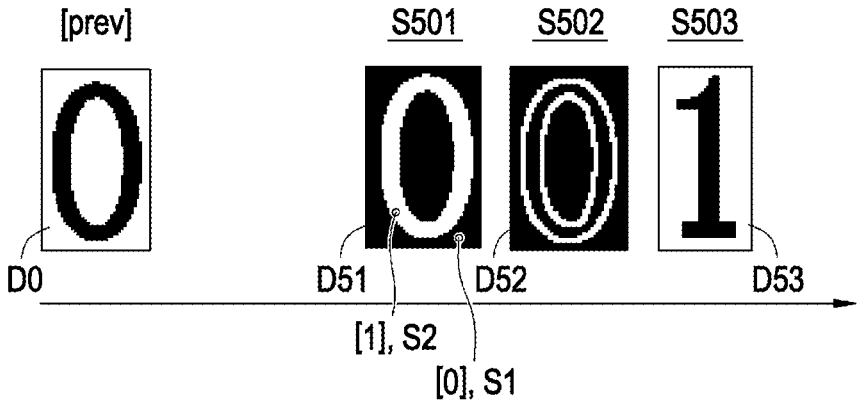
FIG. 7B is a diagram illustrating image data that is used in a driving method according to a comparative example.

FIG. 7A is a diagram illustrating image data that is used in the driving method according to the present embodiment. FIG. 7B is a diagram illustrating image data that is used in a driving method according to a comparative example.

Figure 8:
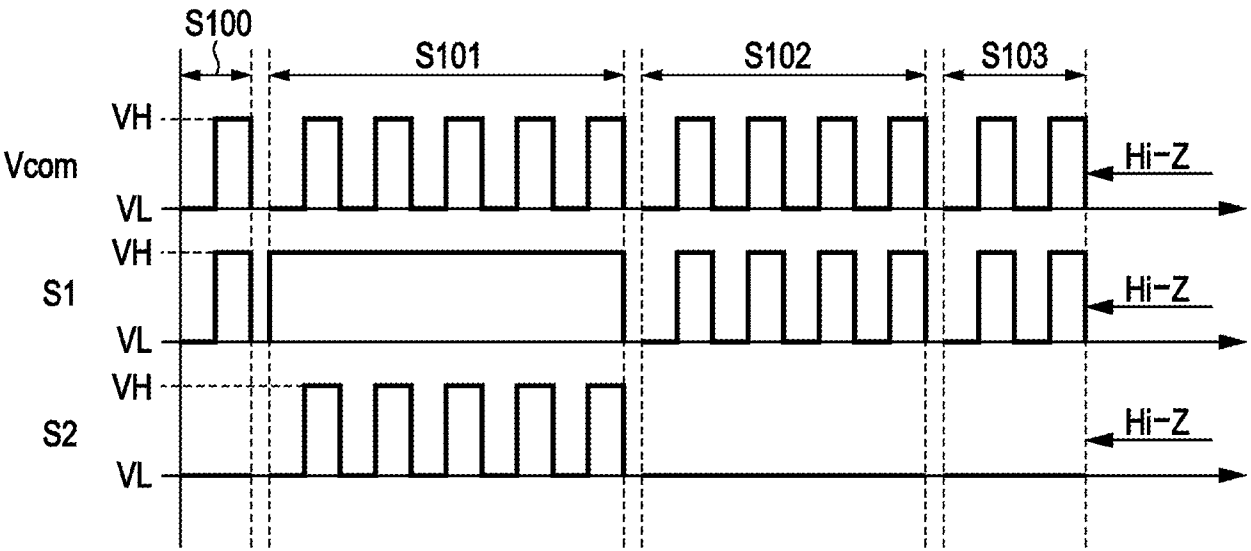
FIG. 8 is a timing chart that corresponds to the flowchart illustrated in FIG. 5.

FIG. 8 is a timing chart that corresponds to the flowchart illustrated in FIG. 5 and illustrates the potential Vcom of the common electrode 37 in each step of the driving method, the potential S1 of the first control line 91 in each step of the driving method, the potential S2 of the second control line 92 in each step of the driving method.

FIG. 6A illustrates the case in which a character "0" (first image TX1) that represents the first digit of minutes of the time "12:00" displayed on the display unit 5 is changed to a character "1" (second image TX2) by means of a partial driving function of the electrophoretic display device 100 so that the time "12:01" is displayed.

As illustrated in FIG. 5, the driving method according to the present embodiment includes: a first image deleting step S100; a combined image displaying step S101; a second image deleting step S102; and an outline deleting step S103.

Before the first image deleting step S100, the display unit 5 is in a state in which an operation for displaying an image that represents "12:00" (as illustrated in FIG. 6A) has been completed, and the circuits that are connected to the display unit 5 are in a power-off state. When the driving method proceeds to the first image deleting step S100, power is supplied to the scanning line driving circuit 61, the data line driving circuit 62 and the common power supply modulating circuit 64 so that potentials can be applied from the lines connected to the circuits. In addition, power is supplied to the latch circuits 70 of the pixels 40 through the low-potential power supply line 49 and the high-potential power supply line 50 so that image signals can be stored in the latch circuits 70.

In the first image deleting step S100, after the circuits are turned on, image signals are input to the latch circuits 70 of the pixels 40. Specifically, when a pulse of a high (H) level (for example, 7 V) that is the selection signal is input to any of the scanning lines 66, the selecting transistors 41 connected to the scanning line 66 are turned on so that the data lines 68 and the latch circuits 70 are connected to each other. Then, the image signals are input to the latch circuits 70 from the data lines 68 through the selecting transistors 41.

In the present embodiment, image signals that correspond to image data D1 illustrated in FIG. 7A are input to the latch circuits 70. In the image data D1 illustrated in FIG. 7A, white dots correspond to image data "1", while black dots correspond to image data "0". In FIG. 7A, only the image data D1 that is input to the pixels 40 that are regions to be updated in the display unit 5 is illustrated. All image data that is input to the other pixels 40 in the display unit 5 is image data "0" (corresponding to black dots in FIG. 7A).

The image data D1 that is used in the first image deleting step S100 is formed by reversing black and white dots of an image obtained by subtracting image data corresponding to the second image TX2 (character "1") from image data corresponding to the first image TX1 (character "0"). That is, the image data D1 is subtracted image data. Since the image data D1 is used, a common portion of the first and second images TX1 and TX2 is not rewritten.

In each of the pixels 40 (corresponding to image portions that are included in the first image TX1 (character "0") and are to be deleted) that correspond to the white dots of the image data D1, an image signal of a high (H) level (for example, 5 V), which corresponds to the image data "1", is input to the latch circuit 70 from the data line 68 through the selecting transistor 41. Thus, the potential of the data output terminal N2 of the latch circuit 70 is set to a low level (for example, 0 V). As a result, in each of the pixels 40 that correspond to the white dots of the image data D1, the second transmission gate TG2 is turned on, and the second control line 92 (potential S2) is electrically connected to the pixel electrode 35.

In each of the pixels that correspond to the black dots of the image data D1, an image signal of a low (L) level (for example, 0 V), which corresponds to the image data "0", is input to the latch circuit 70 from the data line 68 through the selecting transistor 41. Thus, the potential of the data output terminal N2 of the latch circuit 70 is set to a high level (for example, 5 V) for inputting the image signal. As a result, in each of the pixels 40 that correspond to the black dots of the image data D1, the first transmission gate TG1 is turned on, and the first control line 91 (potential S1) is electrically connected to the pixel electrode 35.

In the process of inputting the image signals, the first control line 91 and the second control line 92 may remain in a high impedance state. This can prevent a display state of the display unit 5 from being changed during the operation for inputting the image signals. Even when only a part of the display unit 5 is to be rewritten to display time indicated by a clock, and potentials are applied to the first control line 91 and the second control line 92 in the process of inputting the image signals, the usability of the display unit 5 is not affected very much.

When the image signals are input to the pixels 40, respectively, the electrophoretic element 32 is driven so that the image is displayed. A potential Vdd of the high-potential power supply line 50 is increased from the high-level potential for inputting the image signals to a high-level potential (for example, 15 V) for displaying the image. A potential Vss of the low-potential power supply line 49 is set to a low-level potential (for example, 0 V) for displaying the image.

As illustrated in FIG. 8, a rectangular pulse is input to the common electrode 37 (potential Vcom), and a rectangular pulse that has the same shape as the rectangular pulse input to the common electrode 37 and is synchronized with the common electrode 37 is input to the first control line 91 (potential S1). A low-level potential VL is applied to the second control line 92.

Due to the applied potential, in each of the pixels 40 that correspond to the white dots of the image data D1, the low-level potential VL is applied to the pixel electrode 35 from the second control line 92 through the second transmission gate TG2. Thus, when the potential Vcom of the common electrode 37 is equal to a high-level potential VH, the electrophoretic element 32 is driven by the difference between the potential of the pixel electrode 35 and the potential of the common electrode 37 and is operated so that the white particles 27 are attracted to the common electrode 37 in order to display a portion of the first image TX1 (character "0") in white. In the present embodiment, however, since the potential of the common electrode 37 is maintained at the high level for a time period (for example, 10 ms to 200 ms) that corresponds to a single pulse, the portion of the first image TX1 is not displayed in white (or the amount of charge in the white particles does not reach a saturated amount) and forms a gray image component img1 illustrated in FIG. 6B.

On the other hand, in each of the other pixels 40 that correspond to the black dots of the image data D1, the rectangular pulse illustrated in FIG. 8 is input to the pixel electrode 35 from the first control line 91 through the first transmission gate TG1. This rectangular pulse has the same shape as the pulse input to the common electrode 37 and is synchronized with the common electrode 37. Thus, there is no difference between the potential of the pixel electrode 35 and the potential of the common electrode 37, and the electrophoretic element 32 is not driven. Thus, in each of the pixels 40 that correspond to the black dots of the image data D1, a displayed image portion is not changed.

In the first image deleting step S100, the portion of the first image TX1, which is displayed on the display unit 5, is changed to the gray image component img1.

Next, in the combined image displaying step S101, image data D2 illustrated in FIG. 7A is transferred to the display unit 5; the image signal of the high level is input to appropriate pixels 40; and the image signal of the low level is input to appropriate pixels 40. As illustrated in FIG. 8, a rectangular pulse that has a shape obtained by periodically repeating the high-level potential VH and the low-level potential VL is input to the common electrode 37, and a rectangular pulse that has the same shape as the rectangular pulse input to the common electrode 37 and is synchronized with the common electrode 37 is input to the second control line 92.

The image data D2 is obtained by subtracting, from the image data corresponding to the second image TX2 (character "1"), a portion (portion corresponding to black dots of image data D0) that is included in the image data corresponding to the first image TX1 (character "0") and constitutes the character "0". That is, the image data D2 is subtracted image data. The use of the image data D2 prevents image signals from being written in duplicate in pixels 40 that correspond to the common portion of the first and second images TX1 and TX2.

In each of the pixels 40 that correspond to black dots of the image data D2, the high-level potential VH is applied to the pixel electrode 35 from the first control line 92 through the first transmission gate TG1. When the potential Vcom of the common electrode 37 is equal to the low-level potential VL, the electrophoretic element 32 is operated so that the black particles 26 are attracted to the common electrode 37 (refer to FIG. 4B). Then, an image component img2 illustrated in FIG. 6B is displayed in black, and a third image TX3 that includes the image component img1 of the first image TX1 and the image component img2 of the second image TX2 is displayed on the display unit 5.

As is apparent from comparison of the image data D2 with the image component img2, a portion of the image component img2 is newly displayed in the combined image displaying step S101. However, a portion that is not included in the image data D2 is not deleted in the first image deleting step S100 and remains displayed in black. As a result, the second image TX2 (character "1") is displayed in black as illustrated in FIG. 6B.

In each of the pixels 40 that correspond to white dots of the image data D2, the second control line 92 is connected to the pixel electrode 35 through the second transmission gate TG2. Thus, the rectangular pulse illustrated in FIG. 8 is input to the pixel electrode 35, and the potential of the pixel electrode 35 is maintained equal to the potential of the common electrode 37. Thus, in each of the pixels 40 that correspond to the white dots of the image data D2, a displayed image portion is not changed.

After the third image TX3 is displayed by the aforementioned operations, the method proceeds to the second image deleting step S102.

In the second image deleting step S102, image data D3 illustrated in FIG. 7A is transferred to the display unit 5; the image signal of the high level is input to appropriate pixels 40; and the image signal of the low level is input to appropriate pixels 40. As illustrated in FIG. 8, a rectangular pulse that has a shape obtained by periodically repeating the high-level potential VH and the low-level potential VL is input to the common electrode 37, and a rectangular pulse that has the same shape as the rectangular pulse input to the common electrode 37 and is synchronized with the common electrode 37 is input to the first control line 91. The low-level potential VL is applied to the second control line 92.

The image data D3 is the same as the image data D1 used in the first image deleting step S100. Since the image data D3 is used, the image component img1 is deleted while the image component img2 is not deleted.

In each of the pixels 40 that correspond to white dots of the image data D3, the low-level potential VL is applied to the pixel electrode 35 from the second control line 92 through the second transmission gate TG2. Thus, when the potential Vcom of the common electrode 37 is equal to the high-level potential VH, the electrophoretic element 32 is operated so that the white particles 27 are attracted to the common electrode 37 and that only the image component img1 illustrated in FIG. 6B is selectively deleted and only the image component img2 remains displayed on the display unit 5.

In each of the pixels 40 that correspond to black dots of the image data D3, a displayed image portion is not changed in the same manner as the first image deleting step S100.

After the image component img1 is deleted in the second image deleting step S102, the method proceeds to the outline deleting step S103.

In the outline deleting step S103, image data D4 illustrated in FIG. 7A is transferred to the display unit 5; the image signal of the high level is input to appropriate pixels 40; and the image signal of the low level is input to appropriate pixels 40. As illustrated in FIG. 8, a rectangular pulse that has a shape obtained by periodically repeating the high-level potential VH and the low-level potential VL is input to the common electrode 37, and a rectangular pulse that has the same shape as the rectangular pulse input to the common electrode 37 and is synchronized with the common electrode 37 is input to the first control line 91. The low-level potential VL is applied to the second control line 92.

The image data D4 is formed by extracting from the image data D1 (D3) only a portion corresponding to the outline of the first image TX1 and causing the outline of the first image TX1 to have a predetermined width (number of dots). Since the image data D4 is used, the outline of the first image TX1, which has not been deleted in the second image deleting step S102, is deleted.

When only some of the pixels 40 included in the display unit 5 are driven to delete an image, the shape of an electric field that acts on the electrophoretic element 32 when the image is deleted is different from the shape of an electric field that has acted on the electrophoretic element 32 when the image has been written. In addition, response properties of the electrophoretic particles vary depending on the type of the electrophoretic particle. Accordingly, a light artifact of an outline of the image may occur. In the outline deleting step S103, an artifact of the outline of the image can be deleted, and the image can be displayed with high quality.

Image components that are constituted by white dots of the image data D4 are formed by expanding, by one dot toward the outside of the character "0", curved image components that are constituted by dots constituting the outline of the character "0" and included in a region of the white dots of the image data D1. In other words, the image components are image data on curved lines that have a width of two dots and a center line between white dots of the image data D1 and black dots of the image data D1.

In the outline deleting step S103, in each of the pixels 40 that correspond to the white dots of the image data D4, the low-level potential VL is applied to the pixel electrode 35 from the second control line 92 through the second transmission gate TG2. Thus, when the potential Vcom of the common electrode 37 is equal to the high-level potential VH, the electrophoretic element 32 is operated so that the white particles 27 are attracted to the common electrode 37 and that an artifact of the outline of the image component img1, which has not been deleted in the second image deleting step S102, can be deleted.

In each of the pixels 40 that correspond to black dots of the image data D4, a displayed image portion is not changed in the same manner as the second image deleting step S102.

The second image TX2 (character "1") is displayed as illustrated in FIG. 6B and the clock time is updated to "12:01" on the display unit 5 as illustrated in FIG. 6A by the steps S100 to S103.

As described above in detail, in the method for driving the electrophoretic display device according to the present embodiment, the first image TX1 is changed to the second image TX2 on the display unit 5, while the third image TX3 that includes the image component img1 of the first image TX1 and the image component img2 of the second image TX2 is displayed after the display of the first image TX1 and before the display of the second image TX2.

The driving method suppresses the display of a blank image and the display of an image after a waiting period and provides an improved display quality. Next, advantages of the invention are described in detail with reference to FIG. 7B.

In FIG. 7B, a series of image data D0, D51 to D53, which are used to change the first image TX1 to the second image TX2 without the third image TX3, are illustrated. When the second image TX2 is to be displayed using the image data D51 to D53, a image deleting step S501, an outline deleting step S502 and a image displaying step S503 are sequentially performed in a driving method according to a comparative example.

In the image deleting step S501, the image data D51 is transferred to the display unit 5, and an operation for deleting the first image TX1 is performed on the basis of input image signals. Specifically, pixels 40 that correspond to white dots of the image data D51 are operated so that white particles are attracted to the common electrode 37 and that the first image TX1 is deleted. In each of the other pixels 40 that correspond to black dots of the image data D51, the electrophoretic element 32 is not driven, and a displayed image portion is not changed.

In the outline deleting step S502, an artifact of the outline of the first image TX1, which has not been deleted in the image deleting step S501, is deleted by the same operation as in the outline deleting step S103 performed in the embodiment.

After that, in the image displaying step S503, image data D53 that corresponds to the second image TX2 is input to the display unit 5, and the second image TX2 of a character "1" is displayed on the display unit 5.

In the driving method according to the comparative example, since the entire first image TX1 is deleted by the steps S501 and S502, a blank image appears on the display unit 5 before the second image TX2 is displayed. Thus, the blank image ("12:0") in which the first digit of minutes of the clock time is blank is temporarily displayed. Especially, in a low-temperature environment, the operation of the electrophoretic element 32 may be slow, and it may take a relatively long time to rewrite an image in the driving method according to the comparative example. An image that includes the blank image may be displayed for several seconds. As a result, the display quality may not be sufficient, and this insufficiency may make a user feel stress.

On the other hand, in the driving method according to the present embodiment, the first image TX1 is changed to the second image TX2, while the third image TX3 that includes the image components of the first and second images TX1 and TX2 is displayed after the display of the first image TX1 and before the display of the second image TX2. Thus, at least a portion of any of the first and second images TX1 and TX2 is displayed for a time period for which the steps S100 to S103 are performed. Thus, a blank image does not appear for the time period for which the steps S100 to S103 are performed. Therefore, in the driving method according to the present embodiment, a blank image does not appear, and the display quality is not reduced due to a waiting period. In addition, the driving method according to the present embodiment does not make a user feel stress.

In the driving method according to the present embodiment, the portion of the first image TX1, which is to be deleted, is not changed to a white image portion in the first image deleting step S100 and is changed to the gray image portion (displayed in an intermediate gradation). On the other hand, the second image TX2 is displayed in black in the combined image displaying step S101 by driving the electrophoretic element 32 so that the amount of charge in the black particles reaches a saturated amount.

The driving method is performed as described above. Thus, when the combined image displaying step S101 is performed as illustrated in FIG. 6B, the density of the second image TX2 that is newly displayed can be set to a value that is different from the density of the first image TX1 that has been originally displayed. In this case, the first image TX1 and the second image TX2 can be clearly identified so that the user's visibility can be improved and the display operation does not make the user feel uncomfortable.

In the driving method according to the present embodiment, as illustrated in FIG. 7A, the steps S100 to S103 are performed using the subtracted image data obtained by the predetermined arithmetic processing performed using the image data corresponding to the first image TX1 and the image data corresponding to the second image TX2.

Since the driving method is performed as described above, the common portion of the first and second images TX1 and TX2 is not deleted, and image signals are not written in duplicate in the pixels 40 that correspond to the common portion of the first and second images TX1 and TX2. It is, therefore, possible to reduce loads that are applied to semiconductor elements (such as TFTs that drive the pixels 40) and the electrophoretic element 32.

Especially, it is important that the common portion be not changed to a gray image portion in the first image deleting step S100. The reason is that if the common portion were changed to a gray image portion in the first image deleting step S100 and the image data D2 were written in the combined image displaying step S101, the second image TX2 would have a striped pattern of black and gray portions and the quality of the second image TX2 would be reduced.

In addition, it is important that the pixels 40 that correspond to the common portion be not driven in the outline deleting step S103 in order to ensure reliability of the electrophoretic display device. If the pixels 40 that correspond to the common portion were driven in the outline deleting step S103, the electrophoretic element 32 would be additionally operated to delete the artifact that has remained when the electrophoretic element 32 has been driven so that the balance of a current in the electrophoretic element 32 is maintained, and whereby the balance (DC balance) of the current in the electrophoretic element 32 would be deteriorated. In the present embodiment, however, the pixels 40 that correspond to the common portion are not driven in the outline deleting step S103. Thus, the balance of the current in the electrophoretic element 32 is maintained even when the electrophoretic element 32 is driven, and the reliability of the electrophoretic element 32 can be ensured for a long time.

MODIFIED EXAMPLES

Next, modified examples of the embodiment are described with reference to FIGS. 9A to 10D.

FIGS. 9A to 10D are diagrams illustrating a transition of the display state of the display unit 5 in the case where characters "0", "1", "2" and "3" are sequentially displayed.

In the aforementioned embodiment, when the third image TX3 is displayed, the image component of the first image TX1 is displayed in gray and the image component of the second image TX2 is displayed in black. The third image TX3 is not limited to the image described in the embodiment and may be images described in the following first and second modified examples.

First Modified Example

Figure 9A:
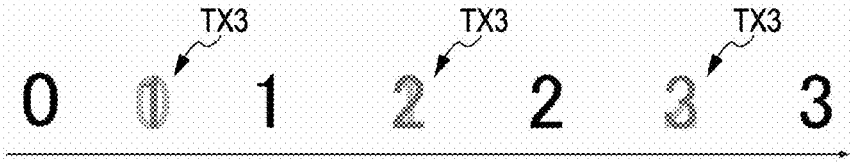
FIGS. 9A and 9B are diagrams illustrating third images according to a first modified example.

In the first modified example illustrated in FIG. 9A, in each of the third images TX3, the image component of the first image TX1 (character located on the left side of the third image TX3) is displayed in light gray, and the image component of the second image TX2 (character located on the right side of the third image TX3) is displayed in dark gray.

Figure 9B:
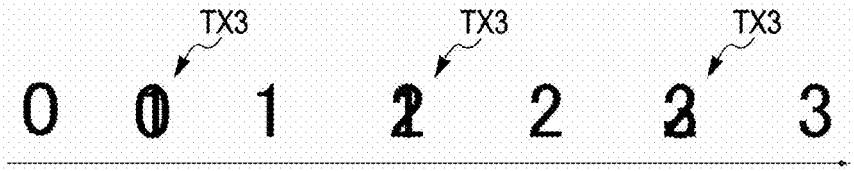

In the first modified example illustrated in FIG. 9B, in each of the third images TX3, the image component of the first image TX1 and the image component of the second image TX2 are displayed in black.

The difference between the densities of the image components of the first and second images TX1 and TX2 included in each of the third images TX3 in the first modified example illustrated in FIG. 9A is smaller than the difference between the densities of the image components of the first and second images TX1 and TX2 included in each of the third images TX3 in the aforementioned embodiment. Thus, when the third images TX3 are each displayed, the difference between the first and second images TX1 and TX2 in the first modified example is identified less clearly than the difference between the first and second images TX1 and TX2 in the aforementioned embodiment. In the first example, however, when the driving method according to the aforementioned embodiment is used, a blank image is not displayed on the display unit 5, and the first image TX1 is changed to the second image TX2 so that the second image TX2 is displayed without a waiting period. Therefore, the same advantages as the aforementioned embodiment can be obtained in the first modified example.

Second Modified Example

In the second modified example illustrated in FIGS. 10A to 10D, an image component that is formed by reversing the image component of the second image TX2 by changing the gradation of the image component of the second image TX2 is used as the image component of each of the third images TX3.

Figure 10A:
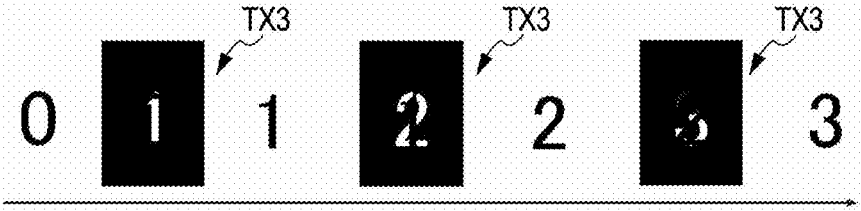
FIGS. 10A to 10D are diagrams illustrating third images according to a second modified example.

In an example illustrated in FIG. 10A, in each of the third images TX3, the image component of the first image TX1 (character located on the left side of the third image TX3) is displayed in black, and an image component that is formed by reversing the image component (displayed in black) of the second image TX2 by changing the gradation of the image component (displayed in black) of the second image TX2 is displayed.

Figure 10B:
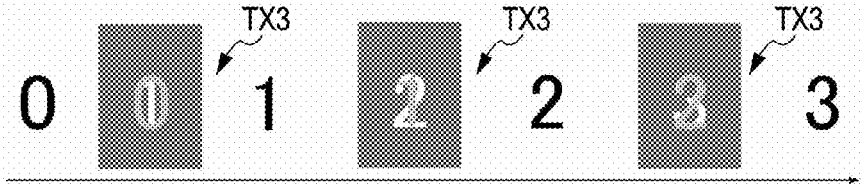

In an example illustrated in FIG. 10B, in each of the third images TX3, the image component of the first image TX1 is displayed in light gray, and an image component that is formed by reversing the image component (displayed in dark gray) of the second image TX2 by changing the gradation of the image component (displayed in dark gray) of the second image TX2 is displayed.

Figure 10C:
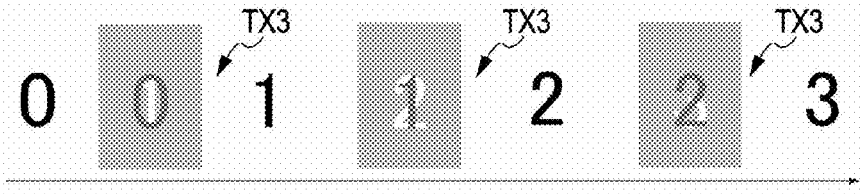

In an example illustrated in FIG. 10C, in each of the third images TX3, the image component of the first image TX1 is displayed in dark gray, and an image component that is formed by reversing the image component (displayed in light gray) of the second image TX2 by changing the gradation of the image component (displayed in light gray) of the second image TX2 is displayed.

Figure 10D:
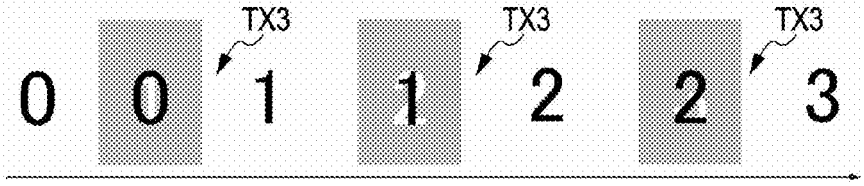

In an example illustrated in FIG. 10D, in each of the third images TX3, the image component of the first image TX1 is displayed in black, and an image component that is formed by reversing the image component (displayed in light gray) of the second image TX2 by changing the gradation of the image component (displayed in light gray) of the second image TX2 is displayed.

In the second modified example illustrated in FIGS. 10A to 10D, the third images TX3 each include an image component that is formed by reversing the image component of the second image TX2 by changing the gradation of the image component of the second image TX2. Thus, the display unit can display a cursor-like image in a region that corresponds to portions that are rewritten when the first image TX1 is changed to the second image TX2. This display operation can inform the user that the image is being rewritten. It is, therefore, possible to reduce stress of the user compared with the case in which a blank image is displayed on the display unit 5 or the case in which the second image TX2 is displayed after a waiting period.

In the second modified example, in each of the third images TX3, an image component that is formed by reversing the image component of the first image TX1 by changing the gradation of the image component of the first image TX1 may be included.

The embodiment and the modified examples describe the electrophoretic display device that includes the latch circuits 70 and the switching circuits 80 in the pixels 40. The driving method according to each of the embodiment and the modified examples can be applied to another type of electrophoretic display devices. Specifically, the driving method according to each of the embodiment and the modified examples can be applied to a segment type electrophoretic display device and a 1T1C type electrophoretic display device that includes a pixel switching element and a capacitor in each of the pixels 40. In addition, the driving method according to each of the embodiment and the modified examples can be applied to an SRAM type electrophoretic display device that does not include a switching circuit 80.

Electronic Devices

Next, an electronic device that includes the electrophoretic display device according to any of the embodiment and the modified examples is described.

Figure 11:
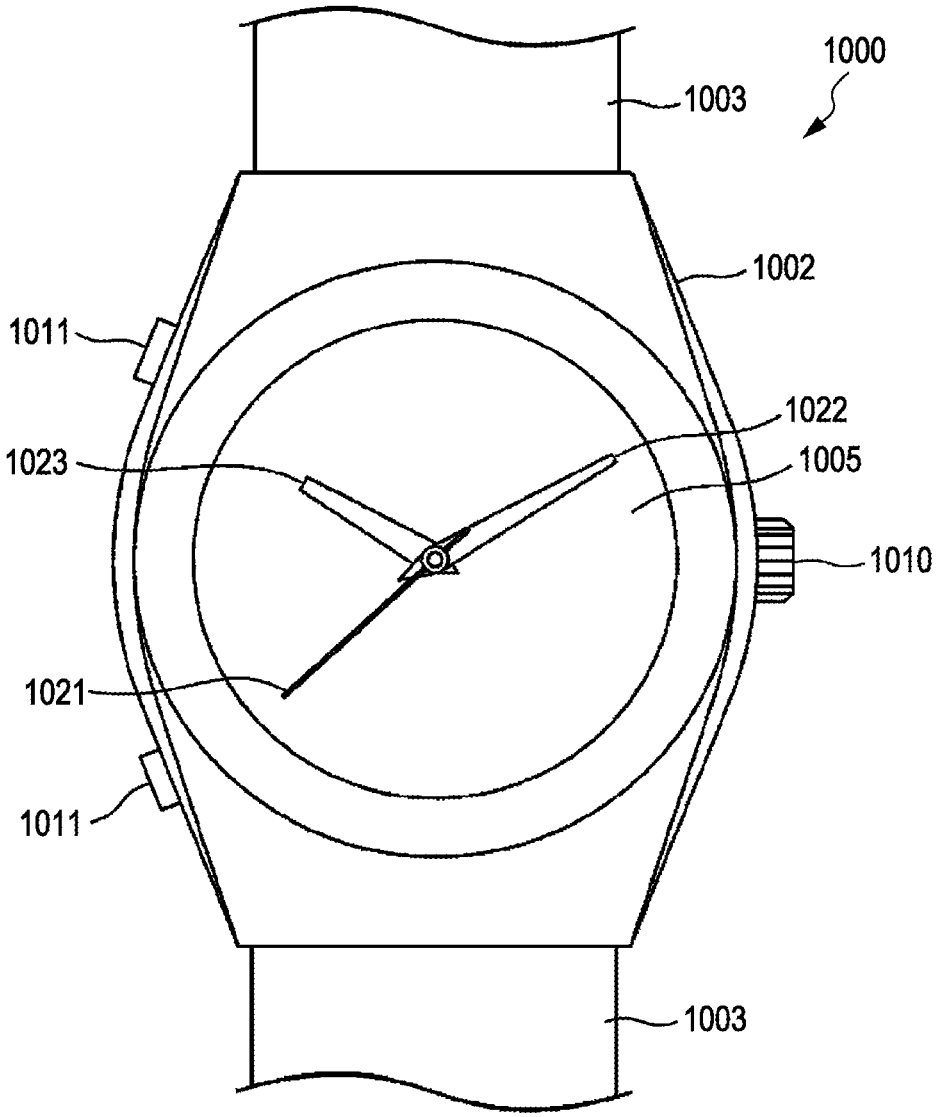
FIG. 11 is a diagram illustrating a wristwatch that is an example of an electronic device.

FIG. 11 is a front view of a wristwatch 1000. The wristwatch 1000 has a wristwatch case 1002 and a pair of bands 1003 that are coupled to the wristwatch case 1002.

A display section 1005, a second hand 1021, a minute hand 1022 and an hour hand 1023, which constitute the electrophoretic display device according to any of the embodiment and the modified examples, are provided on a front surface of the wristwatch case 1002.

A winder 1010 is arranged as an operator on a side surface of the wristwatch case 1002, while operating buttons 1011 are arranged as operators on another side surface of the wristwatch case 1002. The winder 1010 is coupled to a winding stem (not illustrated) provided in the case. The winder 1010 and the winding stem can be moved in multiple stages (for example, two stages) in an integrated manner by pushing and pulling the winder 1010. In addition, the winder 1010 and the winding stem are rotatable in an integrated manner. The display section 1005 can display a background image, character strings (representing a date, a time and the like), the second hand, the minute hand, the hour hand and the like.

Figure 12:
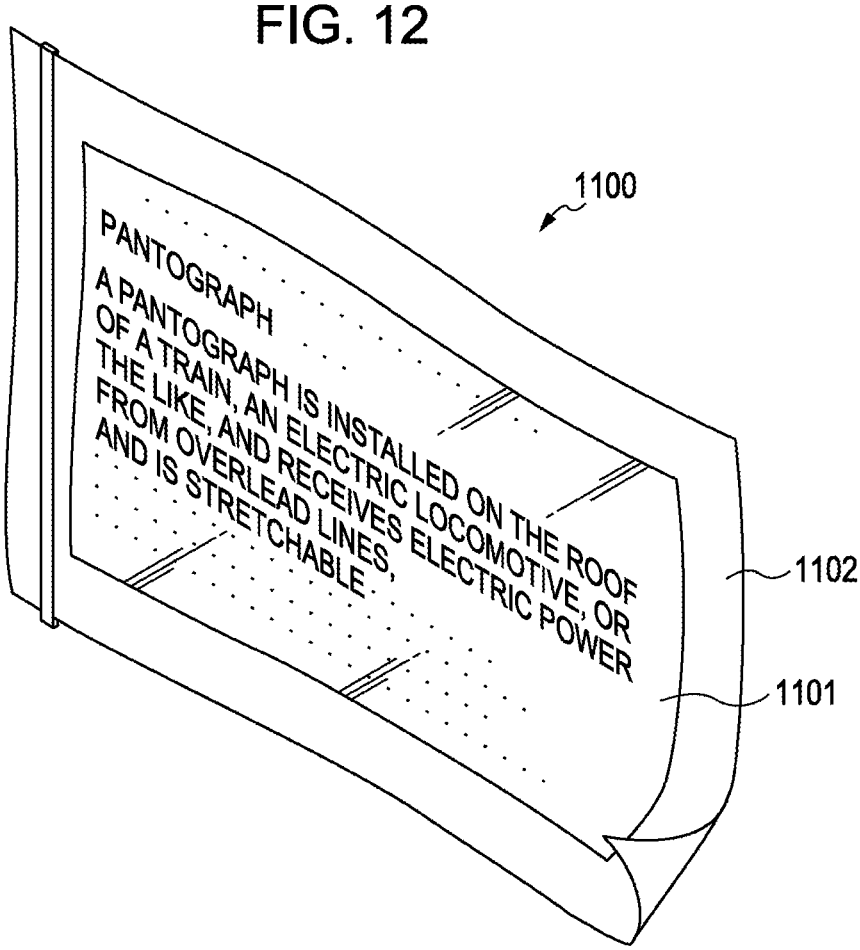
FIG. 12 is a diagram illustrating an electronic paper that is another example of the electronic device.

FIG. 12 is a perspective view of the configuration of an electronic paper 1100. The electronic paper 1100 has the electrophoretic display device according to any of the embodiment and the modified examples in a display region 1101. The electronic paper 1100 is flexible and has a body 1102. The body 1102 is a rewritable sheet that has texture and flexibility that are similar to a conventional paper.

Figure 13:
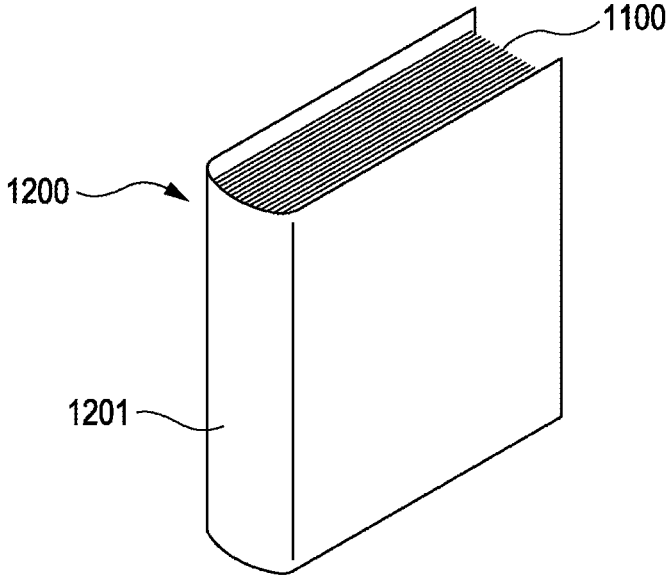
FIG. 13 is a diagram illustrating an electronic notebook that is another example of the electronic device.

FIG. 13 is a perspective view of the configuration of an electronic notebook 1200. The electronic notebook 1200 has a cover 1201 and a plurality of the electronic papers 1100 that are bundled. The electronic papers 1100 are held between portions of the cover 1201. The cover 1201 includes a display data receiving section (not illustrated) that receives display data from, for example, an external device. Thus, the electronic notebook 1200 is capable of changing and updating displayed contents on the basis of the display data while the electronic papers are bundled.

The wristwatch 1000, the electronic paper 1100 and the electronic notebook 1200 each include the electrophoretic display device according to any of the embodiment and the modified examples. Thus, the wristwatch 1000, the electronic paper 1100 and the electronic notebook 1200 each serve as an electronic device that has a display unit that suppresses the occurrences of a blank image and a waiting period and provides an improved display quality.

The aforementioned electronic devices are examples of an electronic device according to the invention. The technical scope of the invention is not limited to the aforementioned electronic devices. For example, the electrophoretic display device according to any of the embodiment and the modified examples can be suitably used as a display unit included in an electronic device such as a mobile phone or a mobile audio device.

The entire disclosure of Japanese Patent Application No. 2009-280633, filed Dec. 10, 2009 is expressly incorporated by reference herein.

What is claimed is:

1. A method for driving an electrophoretic display device that includes a display unit having a plurality of pixels and an electrophoretic element provided between a pair of substrates, comprising displaying on the display unit a third image that includes an image component of a first image and an image component of a second image before changing the first image displayed on the display unit to the second image, wherein the third image includes at least a first image component formed by reversing the first image and a second image component of the second image or a third image component of the first image and a fourth image component formed by reversing the second image, deleting the first image immediately before or after the displaying the third image, and deleting at least a part of an outline of the first image after the deleting the first image.

2. The method according to claim 1, wherein during the displaying the third image at least a part of the third image is displayed in an intermediate gradation.

3. The method according to claim 1, wherein the third image includes at least either the first image component by changing the gradation of the first image or the fourth image component by changing the gradation of the second image.

4. The method according to claim 1, wherein during the displaying the third image, subtracted image data is used, the subtracted image data being obtained by arithmetic processing performed using image data corresponding to the second image or image data corresponding to an image formed by reversing the second image by changing the gradation of the second image and image data corresponding to the first image or image data corresponding to an image formed by reversing the first image by changing the gradation of the first image.

5. The method according to claim 1, wherein during the deleting the first image, subtracted image data is used, the subtracted image data being obtained by arithmetic processing performed using image data corresponding to the second image or image data corresponding to an image formed by reversing the second image by changing the gradation of the second image and image data corresponding to the first image or image data corresponding to an image formed by reversing the first image by changing the gradation of the first image.

6. The method according to claim 1, wherein during the deleting the first image, image data that is obtained by subtracting image data on the outline of the first image from image data on the second image is used.

7. An electrophoretic display device comprising:

a display unit that includes a plurality of pixels and an electrophoretic element provided between a pair of substrates; and a control section that controls the pixels, wherein the control section performs a combined image display operation to cause the display unit to display a third image that includes an image component of a first image and an image component of a second image before the first image that is displayed on the display unit is changed to the second image, and wherein the third image includes at least a first image component formed by reversing the first image and a second image component of the second image or a third image component of the first image and a fourth image component formed by reversing the second image, wherein the control section performs an image deleting operation to delete the first image immediately before or after the combined image display operation, and wherein the control section performs an outline deleting operation to delete at least part of an outline of the first image after the image deleting operation.

8. The electrophoretic display device according to claim 7, wherein the control section causes the display unit to display at least a part of the third image in an intermediate gradation during the combined image display operation.

9. The electrophoretic display device according to claim 7, wherein the third image includes at least either the first image component by changing the gradation of the first image or the fourth image component by changing the gradation of the second image.

10. The electrophoretic display device according to claim 7, wherein image data used in the combined image display operation is subtracted image data obtained by arithmetic processing performed using image data corresponding to the second image or image data corresponding to an image formed by reversing the second image by changing the gradation of the second image and image data corresponding to the first image or image data corresponding to an image formed by reversing the first image by changing the gradation of the first image.

11. The electrophoretic display device according to claim 7, wherein image data used in the image deleting operation is subtracted image data obtained by arithmetic processing performed using image data corresponding to the second image or image data corresponding to an image formed by reversing the second image by changing the gradation of the second image and image data corresponding to the first image or image data corresponding to an image formed by reversing the first image by changing the gradation of the first image.

12. The electrophoretic display device according to claim 7, wherein image data used in the outline deleting operation is image data obtained by subtracting image data on the outline of the first image from image data on the second image.

13. An electronic device comprising the electrophoretic display according to claim 7.

14. An electronic device comprising the electrophoretic display device according to claim 8.

15. An electronic device comprising the electrophoretic display device according to claim 9.

16. An electronic device comprising the electrophoretic display device according to claim 10.

* * * * *